US012440075B2

(12) United States Patent
Barr

(10) Patent No.: US 12,440,075 B2
(45) Date of Patent: Oct. 14, 2025

(54) DISPOSABLE AND BIODEGRADABLE POTTY TRAINING PAD

(71) Applicant: April Barr, Henderson, NV (US)

(72) Inventor: April Barr, Henderson, NV (US)

( * ) Notice: Subject to any disclaimer, the term of this patent is extended or adjusted under 35 U.S.C. 154(b) by 0 days.

(21) Appl. No.: 17/393,525

(22) Filed: Aug. 4, 2021

(65) Prior Publication Data

US 2022/0039619 A1 Feb. 10, 2022

Related U.S. Application Data

(60) Provisional application No. 63/061,987, filed on Aug. 6, 2020.

(51) Int. Cl.
*A47K 13/06* (2006.01)

(52) U.S. Cl.
CPC ..... *A47K 13/06* (2013.01)

(58) Field of Classification Search
CPC ..... A47K 13/005; A47K 13/14
USPC ..... 4/245.4
See application file for complete search history.

(56) References Cited

U.S. PATENT DOCUMENTS 1,301,779 A * 4/1919 Young ..... A47K 13/16 4/245.4
1,733,080 A * 10/1929 Hamilton ..... H04Q 3/00 4/245.3
1,894,387 A * 1/1933 Weis ..... A47K 13/06 4/239
2,825,070 A 3/1958 Zareh et al.
3,153,248 A 10/1964 Miller
3,316,560 A 5/1967 Montaldo
3,688,742 A 9/1972 Mcgee
D255,922 S 7/1980 Price et al.
D305,793 S 1/1990 Cronk
5,136,731 A 8/1992 Caro et al.
D356,860 S * 3/1995 Bosje ..... D23/311

(Continued)

FOREIGN PATENT DOCUMENTS

EP 2143364 1/2010

OTHER PUBLICATIONS

"Disposable Toilet Seat Covers", Amazon, amazon.com, ASIN: B0743N2R1S, Oct. 24, 2017 (date of first review) https://www.amazon.com/Disposable-Toilet-Seat-Covers-Toddlers/dp/B0743N2R1S.

(Continued)

*Primary Examiner* — Benjamin R Shaw
(74) *Attorney, Agent, or Firm* — Donn K. Harms

(57) ABSTRACT

A disposable and biodegradable potty training pad for training children on how to use private and public toilets properly. The potty training pad includes a pad having a central opening, a top surface, a bottom surface including at least one pad attachment for releasably attaching the potty training pad to a toilet seat, a pair of hand flaps provided on opposite sides of the potty training pad for releasably attaching to opposite sides of a toilet during use, and a pull handle for easily removing the potty training pad off the toilet seat after use. A seat section of the potty training pad covers a portion of the opening of the toilet seat to accommodate the anatomical contour of a child's bottom, and encourage use by stemming the intimidating size of a toilet bowl opening of feared by children during training. The potty training pad may include a front flap to provide a sanitary barrier during use.

20 Claims, 5 Drawing Sheets

(56) References Cited

U.S. PATENT DOCUMENTS

| | | | | |
|---|---|---|---|---|
| 5,537,693 | A * | 7/1996 | Dossola | A47K 13/16 4/245.7 |
| 5,619,757 | A | 4/1997 | Baratta | |
| 6,073,274 | A * | 6/2000 | McQueen | A47K 13/16 4/245.7 |
| 6,401,264 | B1 * | 6/2002 | Abesamis | A47K 13/005 4/245.4 |
| 6,473,911 | B2 | 11/2002 | Weiss | |
| D485,891 | S | 1/2004 | Bernsley | |
| 6,813,784 | B1 * | 11/2004 | Thompson | A47K 13/16 4/245.4 |
| 6,968,578 | B2 | 11/2005 | Bernsley | |
| 6,996,859 | B1 * | 2/2006 | Alonso | B32B 27/34 4/244.1 |
| 7,996,930 | B2 | 8/2011 | Carter et al. | |
| D813,997 | S | 3/2018 | Mcguire | |
| 10,105,021 | B1 * | 10/2018 | McGuire | A47K 13/02 |
| 2003/0024037 | A1 | 2/2003 | Vreugde | |
| 2003/0208836 | A1 | 11/2003 | Bankemper | |
| 2004/0261163 | A1 * | 12/2004 | Chang | A47K 13/16 4/245.4 |
| 2007/0033720 | A1 * | 2/2007 | Mapenzi-Xe | A47K 13/14 4/245.4 |
| 2008/0244814 | A1 | 10/2008 | Martin | |
| 2009/0013455 | A1 | 1/2009 | Richardson | |
| 2009/0070921 | A1 | 3/2009 | Young | |
| 2009/0217449 | A1 * | 9/2009 | Heath | A47K 11/02 4/245.7 |
| 2011/0099699 | A1 * | 5/2011 | Spievey | A47K 13/14 4/245.8 |
| 2012/0042443 | A1 * | 2/2012 | Aguila | A47K 13/06 4/245.6 |
| 2016/0206158 | A1 * | 7/2016 | Boillat-Macon | A47K 13/14 |
| 2016/0278587 | A1 * | 9/2016 | Blanchard | A47K 13/14 |
| 2021/0093129 | A1 * | 4/2021 | Yerenburg | A47K 13/06 |

OTHER PUBLICATIONS

"Potty Topper—Disposable toilet seat cover!", Potty Training Concepts, pottytainingconcepts.com, Mar. 5, 2011 https://web.archive.org/web/20110305135006/https://www.pottytrainingconcepts.com/Potty-Seat-Disposable-GDG.html.

"Supermore Upgrade Folding Portable Travel Potty Seat", Amazon, amazon.com, ASIN: B07S8NBZY3, Jul. 25, 2019 (date of first review) https://www.amazon.com/Supermore-Portable-Silicone-Reusable-Training/dp/B07S8NBZY3.

* cited by examiner

DISPOSABLE AND BIODEGRADABLE POTTY TRAINING PAD

CROSS-REFERENCE TO RELATED APPLICATIONS

This application claims the benefit of U.S. Provisional Patent Application Ser. No. 63/061,987, filed on Aug. 6, 2020, which is incorporated by reference herein in its entirety.

FIELD OF THE INVENTION

The present invention relates to potty training devices, and more particularly, to a disposable, biodegradable potty training pad for training and encouraging children to use toilets while preventing exposure to germs, viruses, and other communicable diseases during use.

BACKGROUND OF THE INVENTION

Children often face various physical and mental challenges during the early stages of hygiene development. Parents are typically equipped with the necessary skills and natural instincts needed to train their children in understanding the proper behavior needed when dealing with natural biological processes of the body. A natural occurrence of the human body typically includes the need for managing biological waste. To address such needs, parents often begin a period of "potty training" to train their children in using modernized toilets. Such toilets are typically designed, and sized to accommodate adults in general, and can pose difficulty for children to use. As such, the task of training children to use toilets can be daunting for some parents. The task is more challenging when training occurs outside the comfort of a home such as when a parent is accompanied by a child at a store or restaurant, and the child suddenly needs to potty. In many cases, using public toilets can pose a greater risk of managing hygiene attributed to the sanitary conditions of public toilets. Itis often the case the people find themselves rushing when using public toilets due to limited privacy, or the fear of exposing themselves in unfamiliar surroundings.

Various potty training aids or devices have been developed in an effort to assist parents in potty training their children. For example, some potty training aids include, body elevating plastic seats constructed as one molded unit, protective toilet seat covers comprising thin paper sheets often packaged in dispensers located adjacent toilets in public restrooms, fabric toilet seat covers that includes an elastic band for securing the fabric seat covers to the seat or bowl of the toilet to help retain the seat cover in place, and various other protective toilet seat covers that are often constructed from a pliable, cardboard material.

Conventional potty training aids have various drawbacks that pose greater challenges and difficulties to parents when training their children to use toilets properly. For example, the molded plastic seats are typically large and bulky in size making it difficult for parents to use and provide limited portability, thin paper seat covers tear easily, and fail to adequately remain in place on toilet seats, and fabric toilet seat covers are more expensive, and not disposable requiring the need to wash them. Other disadvantages include potty training aids that provide no comfort padding or handles while sitting, and most are oversized to accommodate use by adults. Children often fear using toilets because they feel intimidated by the appearance of the large toilet seat, and the large openings of both toilet seat and bowl. Such appearances make children feel like the toilet will swallow them up, or that they will fall into the toilet. In addition, the anatomical contour of a child's bottom is much smaller than that of an adult making it difficult for child to sit comfortably on a toilet seat designed for use by adults. Merely providing a potty training aid that is oversized to cover the entire toilet seat does not address the efficient training aid, and comfort a child needs when learning to use toilets properly.

Accordingly, there is an established need for a solution to at least one of the aforementioned problems. There remains a need for a potty training pad that is releasably attachable to a toilet seat, includes hand flaps having sanitary surfaces for children to hold onto for stabilizing themselves while sitting on potty training pad, includes readily releasable attachments to securely attach the potty training pad securely to a toilet seat with ease, and a pull handle for easily lifting and removing the potty training pad off from the toilet seat after use for disposal. There also remains a need for a potty training pad having a designated section configured to cover a portion of toilet seat and toilet bowl openings to accommodate the anatomical contour of a child's bottom, and encourage the use of toilets by lessening a child's perceived fear associated with the intimidating appearance of toilets having large central openings.

SUMMARY OF THE INVENTION

The present invention is directed to a disposable and biodegradable potty training pad for training children to use toilets provided in both private and public restrooms. The potty training pad includes a pad body having a central opening, and at least one attachment for releasably securing the potty training pad to a toilet seat, a pair of hand flaps releasably attachable to opposite sides of a toilet for children to hold and secure themselves when sitting on the potty training pad, and a pull handle to lift and remove the potty training pad from the toilet seat after use. The potty training pad may include a pee panel to train boys on the proper etiquette of urinating, and a frontal flap that drapes downwards along a vertical axis in the front region of the toilet to prevent the legs and/feet of children from coming into contact with possible germs, or bacteria associated with toilets during use. A designated section of the potty training pad is configured to cover a portion of a toilet seat and toilet bowl opening when mounted on the sitting surface of a toilet seat to accommodate the anatomical contour of a child's bottom, and encourage the use of toilets by lessening a child's perceived fear of falling into the toilet, and intimidating appearance of the toilet seat and toilet bowl openings. A plurality of potty training pads may be packaged into a bag, pouch, and container, for portable transport and use.

An objective of the present invention is to provide a disposable and biodegradable potty training pad for training and encouraging children and toddlers to use toilets typically found in private and public restrooms without experiencing fears associated with being swallowed up by the toilet, being intimidated by the size of the toilet seat, or falling off the toilet and not being able to secure themselves during use while preventing exposure to germs, viruses, or bacteria associated with such toilets.

One embodiment of present invention provides a biodegradable potty training pad removably attachable to a toilet seat of a toilet, the biodegradable potty training pad comprising a pad body including an opening formed through a central area of the pad body defining an inner perimeter, a seat area extending between the inner perimeter and an outer perimeter of the pad body, the seat area including a top surface, a bottom surface opposite the top surface, and a seat section extending from the inner perimeter towards the outer perimeter a predefined distance, the seat section covering a portion of a seat opening of a toilet seat when the pad body is releasably attached to the toilet seat, a pair of hand flaps each having one end attached to opposite sides of the pad body, and including a first surface, a second surface opposite the first surface, and a flap attachment provided on the second surface for releasably attaching each hand flap to sides of a toilet bowl, and a pull handle including a first end and a second end each securely attached to the pad body forming a finger aperture.

In one aspect, there is further provided at least one pad attachment provided on the bottom surface of the seat area where the at least one pad attachment includes a pressure-sensitive adhesive material, two-sided tape, miniature suction cups, or an elastomer. Examples of a pressure-sensitive adhesive material include any of, a natural rubber, silicone, acrylic, styrene, or styrene block copolymer, based adhesives, or biodegradable polymer based adhesive. The seat section is void of the at least one pad attachment.

In one aspect, the at least one pad attachment comprises a plurality of pad attachments that are spaced apart from each other. In another aspect, the at least one pad attachment comprises a single pad attachment extending along the bottom surface of the seat area where the seat section is void of the plurality of pad attachments, and the single pad attachment.

In another aspect, the first surface of each hand flap is impregnated, coated, or covered with an antimicrobial or antibacterial coating or material. The first surface may include friction material to prevent the hands of a user such as a child from slipping off when grasping the sides of a toilet while sitting on the potty training pad. The friction material may include any of a grit material, air bubbles, protrusions, ridges, silicone dots, elastomer, or a rubber material.

In another aspect, the seat section may comprise ½ to 6 centimeters in width, and the distance between the outer annular perimeter and the inner annular perimeter may comprise 4 to 15 centimeters.

In one aspect, artistic or directive indicia is printed, painted, stamped, or embossed on any surface of the potty training pad including anywhere on the pad body, hand flaps, and pull handle. Non-limiting examples of artistic or directive indicia may include: markings, arrows, words, symbols, pictures, images, colors, cartoon characters, shading, names, phrases, motifs, trademarks, logos, emoji's, or any combination thereof.

In one aspect, the seat section of the pad body may include a stiffener, stiffening agent, material, or composite matrix. The stiffening agent may include natural fibers, polymers, fillers, binder, or resin.

In another aspect, the pad body, and/or seat section comprises a semi-rigid body for withstanding downward forces associated with load-bearing weights of children when sitting on the top surface of the pad body.

In yet another aspect, the biodegradable potty training pad may include a front flap including a one end, and another end opposite the one end, where the one end is attached to the pad body, and the another end is removeably detachable from the pad body to extend the front flap downwards along a vertical axis in the front of a support base of a toilet when the pad body is releasably secured to the toilet seat of the toilet to provide a sanitary barrier between the toilet and a child's legs and feet when the child is sitting on the potty training pad. The another end may include a pressure-sensitive adhesive covered by a releasable film for securing the front flap in place when draped downwards in front of the support base of the toilet.

In another aspect, the biodegradable potty training pad may include a pee panel covering the opening of the pad body, and configured to change color when exposed to the acidity of urine. The pee panel may be coated, or saturated with a color changing chemical agent or material that is selected to provide any desired color upon exposure to urine.

In another embodiment of the present invention there is provided a disposable potty aid removably attachable to an upper surface of a toilet seat including a central opening, the disposable potty training pad comprising an annular pad body including an outer perimeter, a pad opening formed in the annular pad body defining an inner perimeter, and a seating area formed between the perimeters, the seating area including a top surface, and a bottom surface opposite the top surface, at least one pad attachment provided on the bottom surface of the seating area, a pair of hand flaps each having one end attached to opposite sides of the annular pad body, and including a hand engaging surface, and a back surface directly opposite the hand engaging surface, a handle securely affixed to the annular pad body, and wherein the seating area includes a seat section extending from the inner perimeter to the outer perimeter a predefined distance, the seat section covering a portion of the central opening of the toilet seat when the annular pad body is releasably attached to toilet seat where the seat section is void of the at least one pad attachment.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

Figure 1:
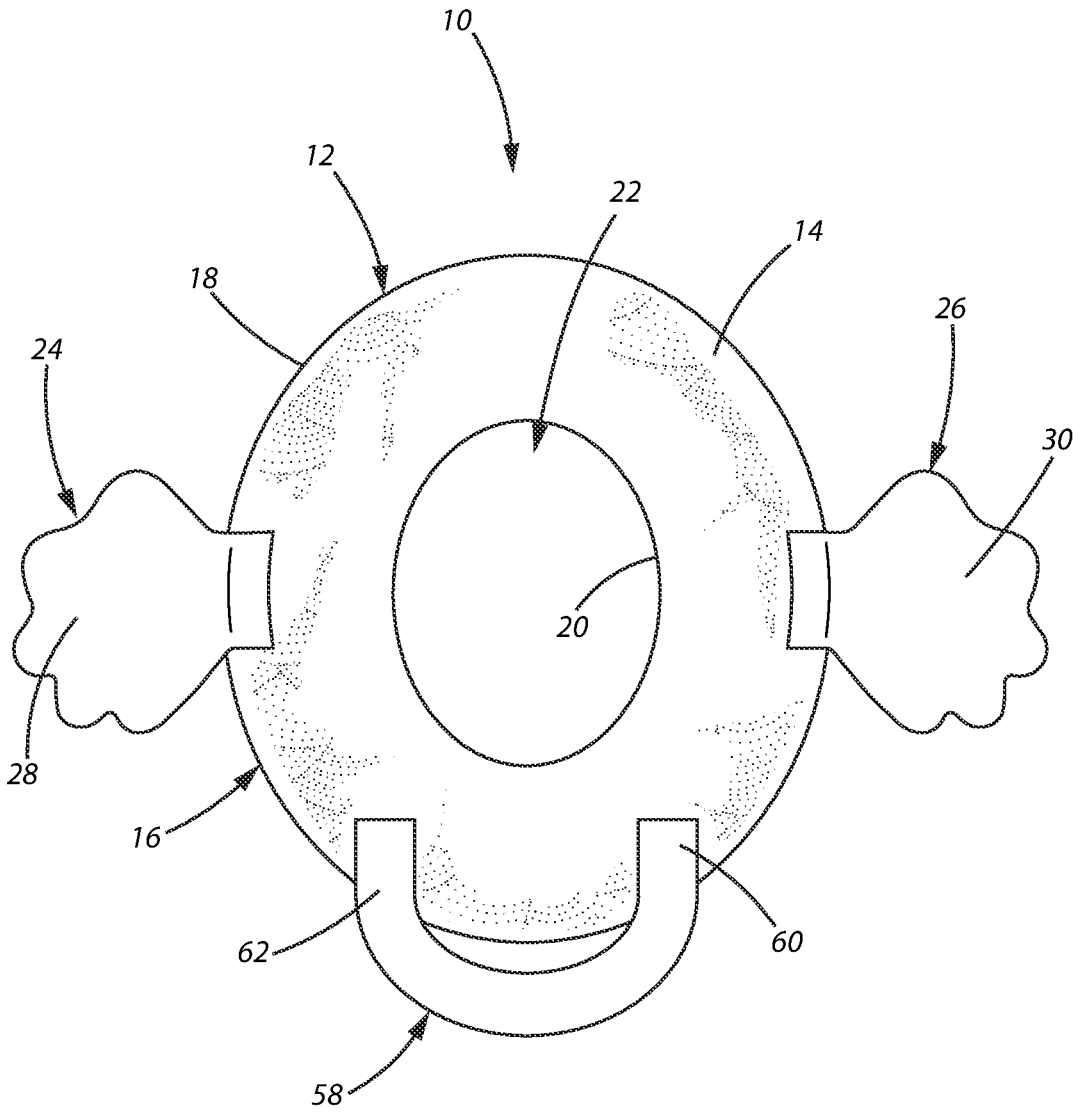
FIG. 1 is a top perspective view of a potty training pad including a pad body, hand flaps extending outwards from the pad body, and a pull handle securely attached to the pad body for forcibly lifting and removing the potty training pad off a toilette seat after use, in accordance with one embodiment of the present invention.

The following detailed description is merely exemplary in nature and is not intended to limit the described embodiments or the application and uses of the described embodiments. Terms and phrases used in this document, and variations thereof, unless otherwise expressly stated, should be construed as open ended as opposed to limiting. The term "including" should be read as meaning "including, without limitation" or the like; the terms "illustrative", "exemplary", or "example" is used to provide exemplary instances or illustrations of the item in discussion, and not an exhaustive or limiting list thereof, or not construed as preferred or advantageous over other implementations; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Furthermore, the use of plurals can also refer to the singular, including without limitation when a term refers to one or more of a particular item; likewise, the use of a singular term can also include the plural, unless the context dictates otherwise.

All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not limiting, unless the claims expressly state otherwise.

Turning now to the detailed description, the term, "toilet", as used herein refers to any general well-known or specifically constructed toilet that typically includes a base associated with a bowl, and a toilet seat aligned over the bowl for accommodating the sitting position of humans for collecting biological human waste. As such, a toilet, as referenced herein, may include toilets associated with private or public restrooms, toilets found in business establishments, offices, clinics, hospitals, restaurants, stores, shopping centers, malls, airplanes, on busses, campers or recreational vehicles, and that include portable travel toilets, portable poly toilets used in many outdoor activities or gatherings, and portable toilet commodes.

Figure 2:
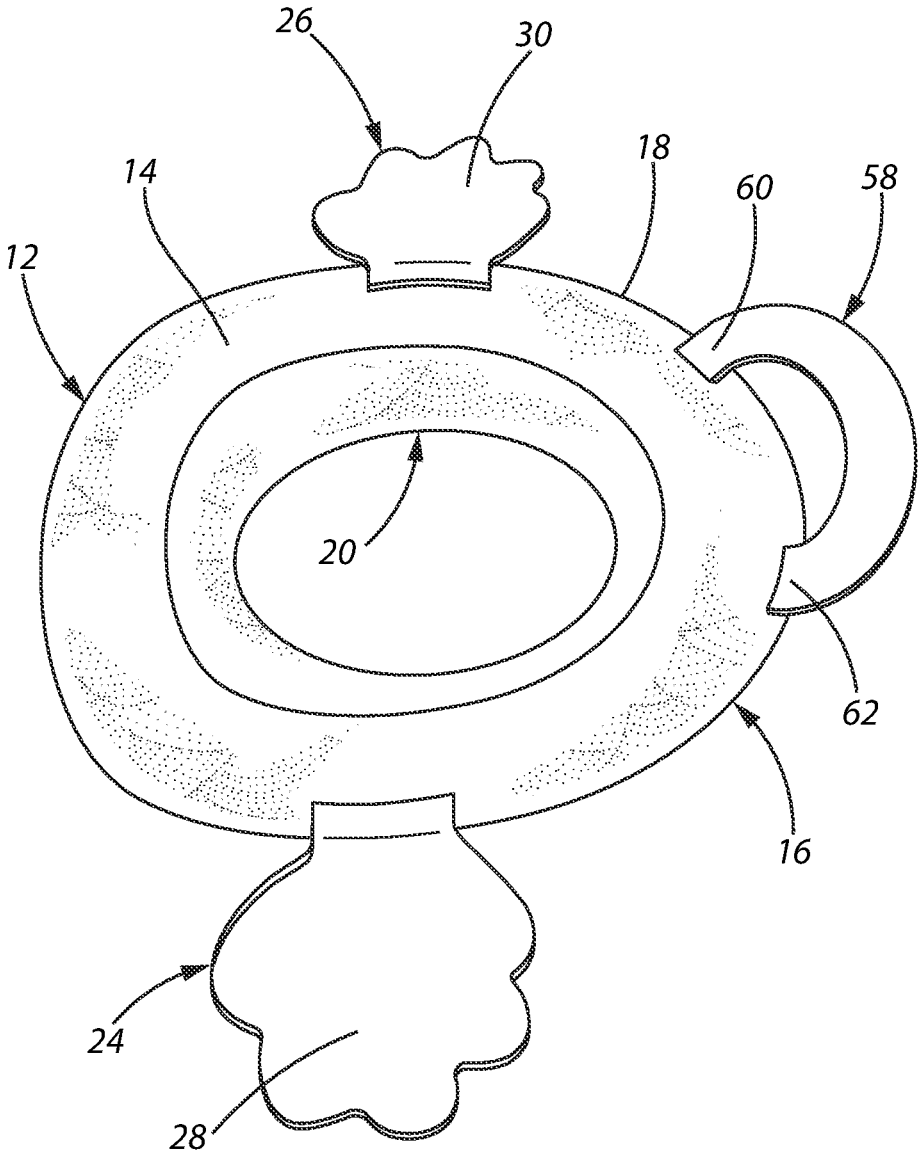
FIG. 2 is a top perspective view of the potty training pad of FIG. 1, shown rotated 90 degrees with hand flaps extended outwards, and pull hand readily accessible for removing and lifting the potty training pad from a toilet seat after use.

Referring now to the figures wherein like elements are represented by like numerals throughout, there are shown in FIGS. 1 and 2, a top and top perspective view, respectively, of a potty training pad 10 for training and encouraging children to use toilets often provided in private and public restrooms while preventing possible exposure to germs, viruses, and bacteria during use, in accordance with one embodiment of the present invention. Potty training pad 10 comprises a a pad body 12 configured to complement a portion of an upper sitting surface of a toilet seat 100, generally denoted in FIG. 4, for accommodating the anatomical contour of a child's bottom with comfort. In one embodiment, pad body 12 comprises a top surface 14, a bottom surface 16 opposite the top surface 14, an outer annular perimeter 18, and an inner perimeter 20 defining a central opening 22 to allow passage of human waste when the potty training pad 10 is releasably secured to toilet seat 100. The pad body 12 may be constructed using a variety of different techniques, machines, or processes. For example, in one non-limiting embodiment, pad body 12 may include a cushion material encased or enclosed in a protective outer covering or liner, similar to a diaper. The cushion material forms an annular sidewall disposed between the top and bottom surfaces 14, 16 of the pad body 12. As appreciated, the height of the annular sidewall is defined by the thickness and amount of cushion material employed. The potty training pad 10 is constructed from materials that provide some resiliency to permit bending and folding, yet includes rigidity to retain a generally planar shape, and withstand the downward bending forces attributed to the load-bearing weight of a child when the child sits on the pad body 12 during use. In yet another example, the potty training pad 10 may be formed as one integral unit constructed from a composite matrix including natural fibers mixed with a resin or polymer binder, where the composite matrix is subject to a mold injection processes to form the potty training pad 10.

The potty training pad 10 may comprise a variety of different, dimensional sizes to accommodate toddlers or children of different ages, weights and sizes. For example, potty training pad 10 may be constructed and characterized as small, medium, or large. The potty pad 10 may comprise an oval, annular, or elliptical shape. As noted, pad body 12 is configured to provide an adequate level of comfort to accommodate the load-bearing weight of a child when sitting on the pad 10, yet is slim enough to permit folding for easy storage, packaging, and disposal. In one non-limiting example, pad body 12 comprises a thickness of approximately ½ to 10 centimeters, as measured between the top surface 14, and bottom surface 16 of the pad body 12. In one embodiment, the width of the seating area, or seating width of the potty training pad 10, defined as the area situated between the outer annular perimeter 18 and the inner annular perimeter 20, may comprise a width of approximately 4 to 15 centimeters. Other sizes may be contemplated and implemented.

With continued reference made to FIGS. 1 and 2, potty training pad 10 further includes a pair of hand flaps 24, 26 that provides several functional benefits. Hand flaps 24, 26 are used to releasably attach the potty training pad 10 in place when positioned on the sitting surface of a toilet seat 100, and include sanitary surfaces 28, 30 for children to place their hands on while grasping the sides of the toilet seat to stabilize themselves when sitting on the potty training pad 10 during use. Each hand flap 24, 26 is separately attached to, or integrally formed with, opposite sides of pad body 12, and are aligned opposite each other on pad body 12. In one non-limiting embodiment, one end of each hand flap 24, 26 is attached to the pad body 12 using any attachment mechanism including for example, glue, adhesive, stitching, heat welding, plastic welding, or ultrasonic welding. In another embodiment, hand flaps 24, 26 are integrally formed with a protective cover or lining used in fabricating the pad body 12. The aligned placement of each hand flap 24, 26 helps prevent the potty training pad 10 from twisting, rotating, or shifting on the toilet seat during use by children.

Each hand flap 24, 26 is sized to effectively accommodate varying sizes of children's hands. In one embodiment, each hand flap 24, 26 may comprise any geometric shape such as a square, round, oval, rectangular, elliptical, or triangular, or comprise the form or shape of an artistic character, figure, object, animal, fish, or motif. For example each flap 24, 26 may comprise a shape of a hand, a shape of a cartoon character, a shape of an animal or animal part, or a fish or part of a fish such as a tail, or comprise the shape of a particular object or article such as a star or the sun. The artistic appearance of hand flaps 24, 26 may help encourage children to want to place their hands on the flaps during use. The exposed sanitary surface 28, 30 of each hand flap 24, 26 may include friction material to prevent a child's hands from slipping off the sanitary surfaces 28, 30 during use. The friction material may include protrusions, ridges, air bubbles, silicone dots, grit material, or rubber that are added to, or made integrally part of, the body 12. In addition, to help reduce the spread of germs, and further promote a child's well-being, and hygiene, each sanitary surface 28, 30 may be impregnated, coated or sprayed with an antimicrobial or antibacterial material or agent. Use of antimicrobial, or antibacterial material or agents help prevent germs from attaching to the inner surface of a child's palms or hands during and after use.

Figure 3:
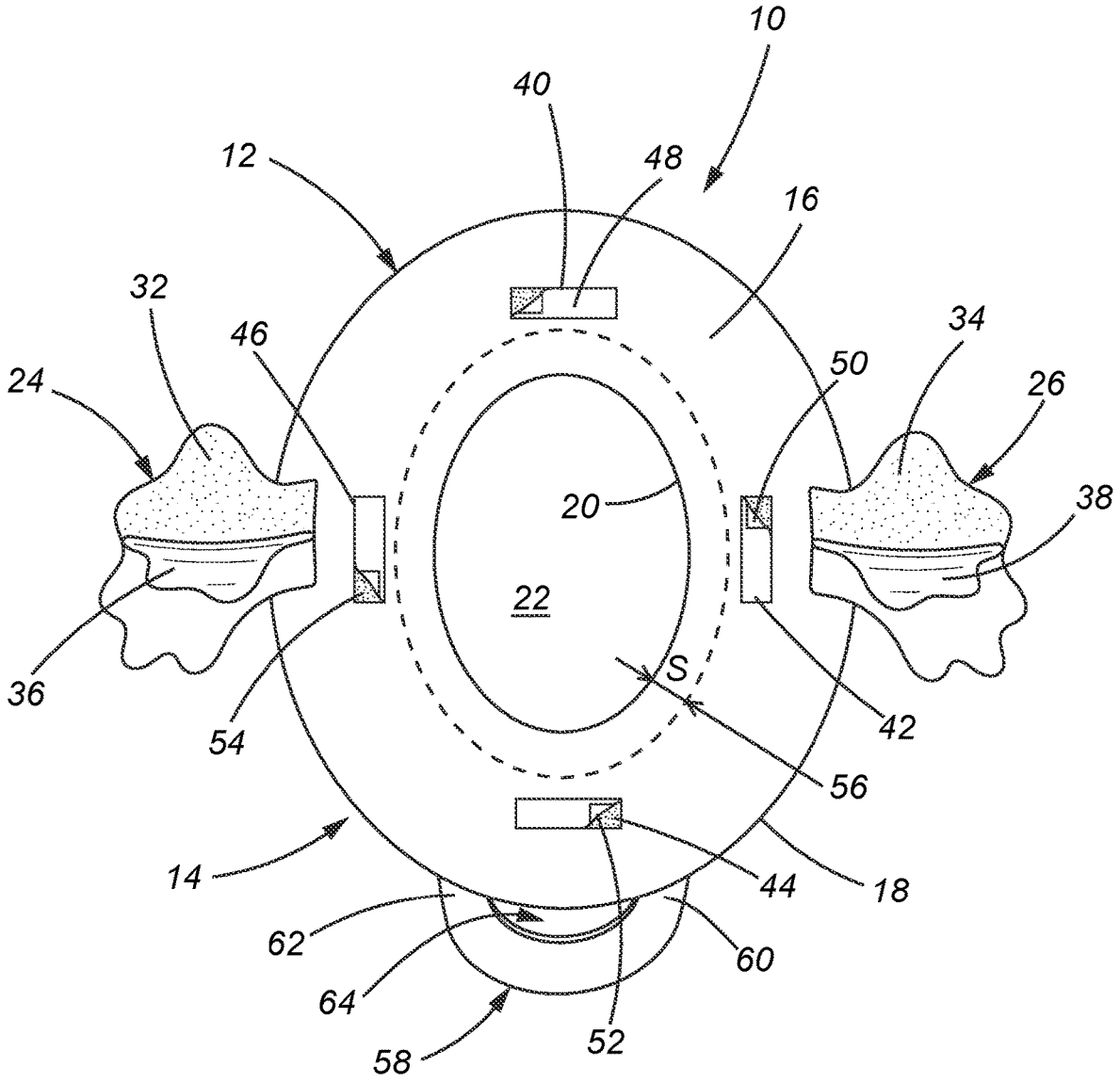
FIG. 3 is a bottom view of the potty training pad of FIG. 1, showing each hand flap including a release film partially removed to expose a pressure-sensitive adhesive material provided on a back surface of each hand flap, at least one attachment shown disposed on a bottom surface of pad body with release films partially removed to expose pressure-sensitive adhesive material of the at least one attachment, and the pull handle.

With continued reference made to FIGS. 1 and 2, the potty training pad 10 also includes a pull handle 58 attached in a general front region or area of pad body 12. Pull handle 58 is designed to allow users to easily and conveniently grasp onto the training pad 10 to lift and remove training pad 10 it completely off the toilet seat after use for proper disposal. In one non-limiting example, pull handle 58 includes a first end 60, and a second end 62, opposite the first end 60, where each end 60, 62 is securely attached to the frontal region of the pad body 12 in a manner that forms an aperture 64 large enough to pass a user's fingers through as illustrated in FIG. 3. After using the potty training pad 10, a user simply grasps the pull handle 58 with one hand, and exerts a lifting force to detachably remove the potty training pad 10 from the upper surface of the toilet seat 100 where the potty training pad 10 can be folded, and discarded. The pull handle 58 is separately attached to, or integrally formed with, the pad body 12, or any portion thereof. The ends 60, 62 of the pull handle 58 are affixed to the top surface 14, the bottom surface 16, the outer perimeter 18, or are partially embedded within the body, of the pad body 12. For packaging purposes, the pull handle 58 is folded and secured to the pot pad 10 using a releasable adhesive, or silicone material. In preparation for using the training pad 10, users simply provide a slight pulling force to detach the pull handle 58 away from the pad body 12 exposing the aperture 64 for readily grasping the pull handle 58 after using the training pad 10. In an alternative embodiment pull handle 58 may include a single loop where opposite ends of a strap are affixed together at a single point to pad body 12. Users can insert one or more fingers through the single loop to pull and remove the potty training pad 10 from toilet seat 100.

Various materials can be used to construct the potty training pad 10 as a whole including the pad body 12, the hand flaps 24, 26, and the pull handle 58. To provide an eco-friendly potty training pad 10, potty training pad 10 is constructed from decomposable or biodegradable materials for the used potty training pad 10 to biodegrade naturally over time. Such biodegradable materials may include, but are not limited to, cotton, organic cotton, polyester, compressed polyester, wool, sew foam, closed or open cell foam, high density polyurethane foam, natural latex foam, antimicrobial foam, fiberfill, nylon, rayon, woven or non-woven fibers, biodegradable plant based materials such as hemp, paper, bamboo, coconut fibers, feather or down, plant-based polyfoam, soybean fiber, woocoa, recycled or post-consumer fibers, biodegradable foams (Bio Foams), other natural plant derived materials, synthetic or non-synthetic fibers, renewable organic materials, wood cellulose, natural or cellulose fibers, alphatic polyesters such as polyhydroxybutyrate, valerate, polycaprolactone, polybutylene succinate, polybutylene succinate, adipate, polyethylene succinate, polylactic acid, polyglycolic acid, polydioxanone, poly (2-oxetanone), cellulose, chitin, chitosan, gluten, gelatin, zein, soy protein, collagen, and keratin to name a few. Natural starches including, for example, corn, waxy corn, wheat, sorghum, rice, potatoes, tapioca, sweet potato, arrowroot, sago palm, cellulosic ether, and natural hemp fiber, aggregate fillers, modified starch, cellulose, chitin, chitosan, gluten, gelatin, zein, soy protein, collagen, keratin, natural rubber; polyethylene glycol, polyvinyl alcohol, polymalic acid, bioplastics, bio-derived polyethylene, polyethylene terephthalate (PET), bio-based polymides (PA) or polyurethanes (PUR), bio-based compostable plastics, such as polylactic acid (PLA), polyhydroxyalkanaoates (PHA), and polybutylene succinate (PBS), or any combination thereof.

Various directive or artistic indicia may be employed to provide directional use, and/or attract the artistic nature of children for enticing them to participate in potty training. For example, artistic or directive indicia can be printed, painted, stamped, or embossed anywhere on the top surface 14 of the pad body 12, on the sanitary surfaces 28, 30 of each respective hand flap 24, 26, and/or on the outer surface of pull handle 58. Non-limiting examples of such artistic or directive indicia may include markings, arrows, words, symbols, pictures, images, colors, cartoon phrases, shading, names, phrases, motifs, trademarks, logos, emoji's, or any combination thereof. The artistic characteristic of each hand flap 24, 26 help to encourage and invite children to properly place their hands on the sanitary surfaces 28, 30, of each respective hand flap 24 and 26, to stabilize and secure themselves while in the sitting position on the potty training pad 10.

Turning to FIG. 3, there is shown a bottom view of the potty training pad 10. Each hand flap 24, 26 includes a release film shown partially removed or peeled away, to expose a pressure-sensitive adhesive material (noted in a shaded color) that is provided on respective back surfaces 32, 34 of each hand flap 24, and 26. It is understood that the pressure-sensitive adhesive material may cover a smaller surface area of the back surfaces 32, 34, can be disposed along the peripheral edge of each back surface 32, 34, or may be disposed on each back surface 32, 34 in a particular manner or layout. In one alternative embodiment, the pressure-sensitive adhesive material, and release film 36, 48 may be replaced with a single sided, or two-sided, sticky tape that extends outwards from each hand flap 24 and 26.

In one embodiment, at least one attachment 40 is provided on the bottom surface 16 of the pad body 12 to releasably secure the potty training pad 10 to the sitting surface of a toilet seat 100. The at least one attachment may comprise any of suction cups, two-face tape, silicone dots, an elastomer, or pressure-sensitive adhesive material including any of a natural rubber, silicone, acrylic, styrene, or styrenic block copolymer, based adhesives, or biodegradable polymer based adhesive. In one embodiment, the at least one attachment includes a plurality of attachments 40, 42, 44, 46 each including a pressure-sensitive adhesive material coverable by a peelable release sheet 48, 50, 52, and 54. In one alternative embodiment, the at least one attachment may comprise a single attachment that comprises a shaped, pressure-sensitive adhesive strip provided along the bottom surface 16 of the pad body 12, where a single release film, that compliments the shape of the shaped, pressure sensitive adhesive strip is used to cover the shaped, pressure-sensitive adhesive strip. For example the shaped pressure-sensitive adhesive strip may comprise an annular shaped adhesive strip, and the release film comprise an annular shaped release film for accommodating covering the annular pressure-sensitive release film. Alternatively, the at least one attachment may comprise two attachments 40, 44, or 42, 46. It is understood that the pressure-sensitive material used for both the at least one attachment, and underside of hand flaps 24, 26 may be laid out as squares, dots, parallel waves or lines, thick lines, or even S swirls. Each release film 36, 38, 48, 50, 52, 54 may comprise any of PCR films, siliconized films, silicone-free release films, wax films, or non-stick plastic film. For added convenience, each release film 36, 38, 48, 50, 52, 54 may include an extended tab (not shown) to assist users to quickly and more easily remove and peel the release films 36, 38, 48, 50, 52, 54 to expose the pressure-sensitive adhesive material in preparation of releasably attaching the potty training pad 10 to the sitting surface of a toilet seat 100.

With continued reference made to FIG. 3, in one embodiment, there is illustrated a dotted line, generally denoted at 56, surrounding the peripheral region of the inner perimeter 20 of opening 22 of the potty training pad 10. The dotted line 56 helps to illustrate and demonstrate the operative characteristic of the potty training pad 10. The area provided between the inner annular perimeter 20, and the dotted line 56, represents a designated, seat section earmarked S. The designated seat section S is configured to partially cover the opening of both the toilet seat 100 and toilet bowl when the potty training pad 10 is secured to the sitting surface of the toilet seat 100.

The at least one attachment includes a plurality of attachments 40, 42, 44, 46 positioned outside the designated seat section S to permit the pressure-sensitive adhesive material, of each attachment 40, 42, 44, 46, to directly attach to the sitting surface of toilet seat 100 assuring a complete, secure attachment of the potty training pad 10 to the toilet seat 100. The plurality of attachments 40, 42, 44, 46 are positioned on the bottom surface 16 of the pad body 12 outside the designated seat section S. Unlike prior art potty training aids where protective seat covers are oversized to simply cover the entire sitting surface of a toilet seat but leave the opening of the toilet bowl completely uncovered, the potty training pad 10 provides a designated seat section S that partially covers, and narrows the size of the opening of the toilet seat, and opening of the toilet bowl, providing the appearance of narrowing the opening of the toilet bowl making less intimidating for children to use. The designated seat section S narrows the opening of the toilet seat to accommodate the anatomical contour of a child's bottom, help prevent a child's bottom from sagging through the toilet seat opening, reduces the intimidating appearance of the size of the toilet bowl that is often perceived by children as being readily capable of swallowing the child, properly aligns a child above the toilet bowl during use, and encourages children to use private or public toilets without fear or being intimidated. The rigid or semi-rigid construction of the pad body 12 provides the counter-upward force needed to withstand the weight-bearing loads of children when sitting on the potty training pad 10. As such, the designated seat section S, of the pad body 12, retains a planar horizontal stance with little to no downward bending when accommodating the weight of a child. Both the at least one attachment 40, 42, 44, 46, and the hand flaps 24, 26 releasably attach to the sitting surface of the toilet seat 100 and to opposite sides of the toilet, respectively, preventing the potty training pad 10 from shifting, rotating, or sliding on the toilet seat further assuring a child's safety. In one embodiment, the at least one attachment 40, 42, 44, 46 and/or hand flaps 24, 26 may be optional.

When the hand flaps 24, 26 are releasably attached to both sides of a toilet, the hand flaps 24, 26 alone may provide enough holding tension to retain the potty training pad 10 in place on the toilet seat 100 without the need for at least one attachment 40, 42, 44, and 46. In another embodiment with the at least one attachment 40, 42, 44, 46 and hand flaps 24, 26 having adhesive materials, they provide enough tension to suspend the potty training pad 10 across the toilet seat 100 when a child is sitting on the potty training pad 10. In either embodiment, the tensile strength of the pad body 12 must exceed the effective weight of the child so that the potty training pad will not tear or break under the weight of a child seated on it. In other words, the adhesives holding the potty training pad 10 to the toilet seat must be sufficient to suspend the potty training pad 10 across a toilet seat while the potty training pad 10 bears the weight of a 10, 15, 20, 25, 30, 35, 40, 45, 50, 55, 60, or 65 pound child and the tensile strength of the pad body 12 is high enough that the pad body 12 will not break or tear under the weight of the child.

Figure 4:
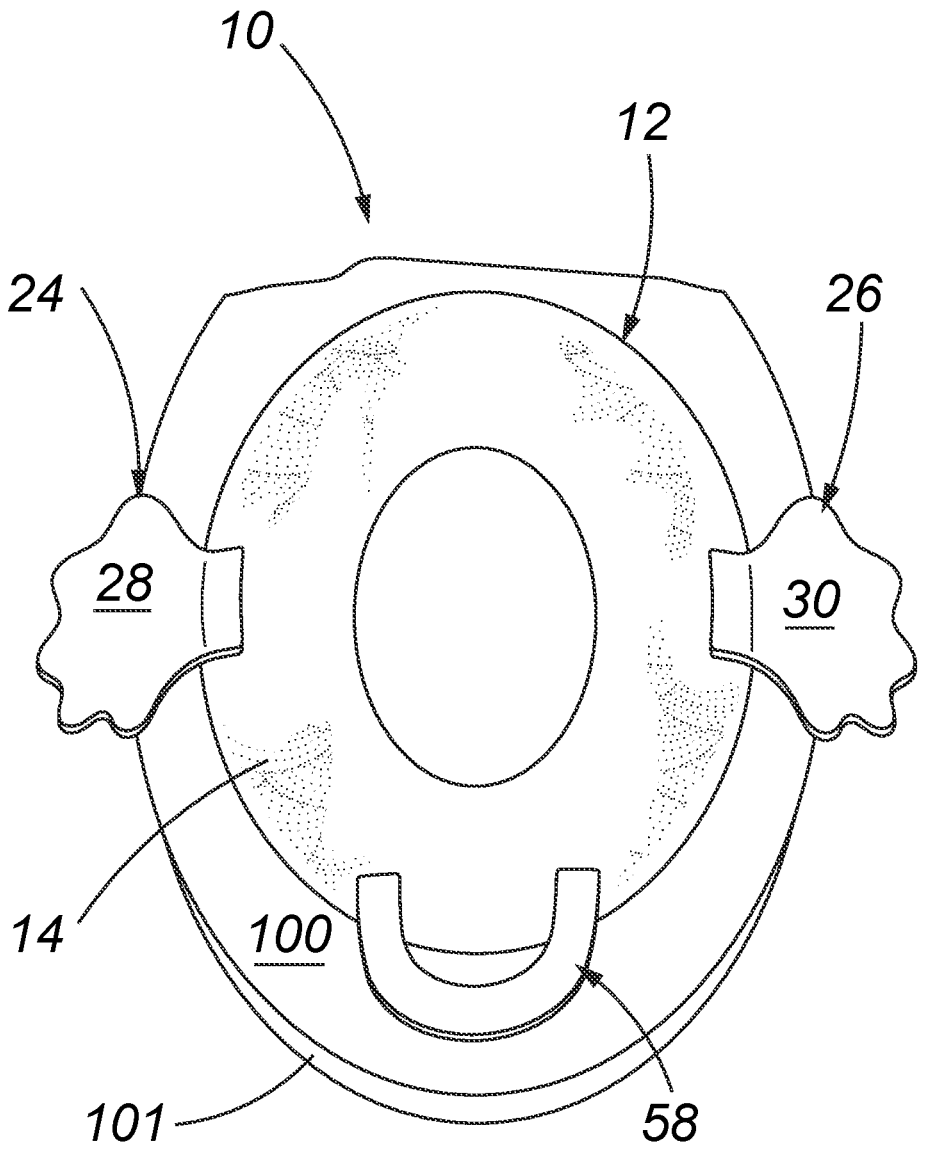
FIG. 4 is a top perspective view of the potty training pad of FIG. 1, shown releasably attached to an upper surface of a toilet seat with hand flaps oriented on opposite sides of a toilet bowl for releasably attaching the hand flaps to the sides of the toilette bowl, and the pull handle readily accessible for forcibly lifting and removing the potty training pad from the toilet seat after use.
Figure 5:
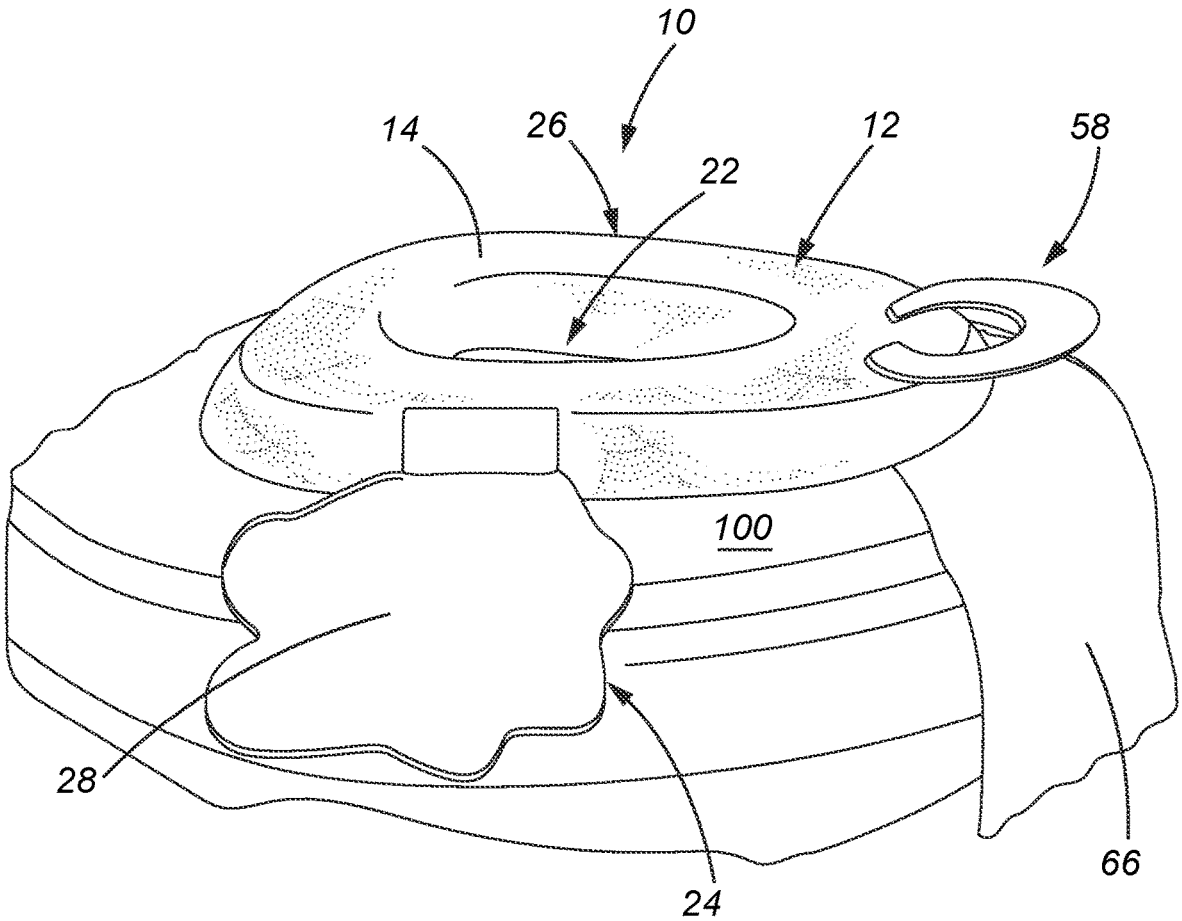
FIG. 5 is a top, side, perspective view of the potty training pad of FIG. 1, shown releasably attached to the upper surface of the toilet seat with the hand flaps securely attached to opposite sides of the toilet bowl to accommodate a child's hands while sitting on the potty training pad, the pull handle, and a frontal flap extending downwards from the potty training pad to drape the front region of the toilet

With reference now made to FIGS. 4, and 5, there are shown a top view, and a top, side perspective view, respectively, of potty training pad 10 readily secured to a toilet seat 100 of a private or public toilet. Installing the potty training pad 10 initially begins by exposing the pressure-sensitive adhesive material of the at least one attachment 40, 42, 44, 46 provided on the bottom surface 16 of the pad body 12. Each release film 48, 50, 52, 54, as illustrated in FIG. 3, is peeled away, and removed. The bottom surface 16 of the pad body 12 is subsequently positioned on the top sitting surface of the toilet seat 100 with the pull handle 58 oriented towards the front region of the toilet. The pad body 12 is positioned on the sitting surface of the toilet seat 100 so that the designated seat section S, of the pad body 12, as shown in FIG. 3, extends inwards narrowing the opening of the toilet seat 100, and toilet bowl. Upon properly orienting and placing the potty training pad 10 on the sitting surface of the toilet seat 100, the user applies a slight, downward pressure onto the top surface 14 of the pad body 12 to firmly adhere the pressure-sensitive adhesive material to the toilet seat 100. Thereafter, each release film 36, 38, of each hand flap 24, 26, is peeled back exposing the pressure-sensitive adhesive material provided on the back surface 32, 34 of each hand flap 24 and 26. Each hand flap 24, 26 is subsequently compressed against opposite sides of the toilet forcing the pressure-sensitive adhesive material to stick securely to the sides of the toilet to further secure the potty training pad 12 on toilet seat 100, as better illustrated in FIG. 5. A child is trained to sit comfortably onto the top surface 14 of the potty training pad 10, and place his or her hands onto the sanitary surfaces 28, 30 of each respective hand flap 24 and 26 to stabilize and secure themselves while sifting onto the potty training pad 10. The inwardly extending designated seat section S, of the pad body 12, narrows the opening of the toilet seat 100 to accommodate the anatomical contour of a child's bottom, and reduce fear of using the toilet. The rigid or semi-rigid characteristic of the pad body 12 withstands the load-bearing weight of the child while sitting on the potty training pad 10 during use. After use, a parent or a child, simply grasps the pull handle 58 with one hand, and removes the potty training pad 10 from the toilet seat 100. The used potty training pad 10 is easily folded and disposed in a local trash bin. Because the potty training pad 10 is constructed using eco-friendly, biodegradable materials, the discarded potty training pads 10 will decompose naturally over time.

In an embodiment where the at least one attachment 40, 42, 44, 46 is omitted, each release film 36, 38, of each hand flap 24, 26 is peeled back to expose the pressure-sensitive adhesive material provided on the back surface 32, 34 of each hand flap 24 and 26. Each hand flap 24, 26 is subsequently compressed against opposite sides of the toilet forcing the pressure-sensitive adhesive material to stick to the sides to further secure the potty training pad 12 on the toilet seat 100, as better illustrated in FIG. 5. In such an embodiment, the adhesive material of the hand flaps 24, 26 secures the potty training pad 12 without the at least one attachment 40, 42, 44, 46.

In an embodiment where the adhesive hand flaps 24, 26 are omitted, each release films 48, 50, 52, 54, as illustrated in FIG. 3, is easily peeled away, and removed. The bottom surface 16 of the pad body 12 is subsequently positioned on the top sitting surface of the toilet seat 100 with the pull handle 58 oriented towards the front region of the toilet. The pad body 12 is also placed on the sitting surface of the toilet seat 100 so that the designated seat section S, of the pad body 12, as shown in FIG. 3, extends inwards to narrow the opening of the toilet seat 100. Upon properly orienting and placing the potty training pad 10 on the sitting surface of the toilet seat 100, the user applies a slight, downward pressure onto the top surface 14 of the pad body 12 to firmly adhere the pressure-sensitive adhesive material to the toilet seat 100. In such an embodiment, the adhesive material of the at least one attachment 40, 42, 44, 46 secures the potty training pad 12 without the adhesive hand flaps 24, 26.

For added convenience, a plurality of potty training pads 10 can be folded and packaged for portable use and transport. For example, an N number of potty training pads 10 can be folded, similar to folding a diaper, and packaged in a container, bag, or pouch for allowing parents to carry a plurality of potty training pads 10 from place to place to have them readily available for training their children while on the go. To enhance sanitary packaging, each potty training pad 10 may be individually wrapped in a separate wrapper or package in a safe and sterile manner. Small wet wipes can be included in the package as well for convenience. In another embodiment, a mechanical dispenser can store and dispense individual potty training pads 10. The mechanical dispenser can be mounted onto a wall in various public or private restrooms, or near diaper changing stations. Janitors responsible for maintaining the restrooms can fill the mechanical dispensers with potty training pads 10 when needed.

An objective for providing a disposable and biodegradable potty training pad 10 is to train children or toddlers to use toilets provided in private or public restrooms without feeling intimidated, being scared, or feeling incapable or insecure in using such toilets. To better understand the physical and mental attributes associated with using the potty training pad 10, there is also provided a potty training pad kit that includes a potty training pad 10, a reward system, and a manual (either in print or available in digital format over the internet). The manual provides instructions on the proper use of the potty training pad 10, may give pointers or tips to help parents better understand and deal with the training process, and may provide information regarding other resources to learn more about potty training. The reward system may comprise a host of stickers, candy, badges, pins, or other articles that is given to a child upon successful use of the potty training pad 10. Cognitive rewards help promote compliance, develop conditioning, and encourage use and participation in the training stages of development. The potty training pad 10 kit may come in a variety of different modalities such as in a bag, box, case, or pouch. Each potty training pad 10 can be tailored to include the name(s) of the child to provide a sense of identity during the stages of training.

In one embodiment, the potty training pad 10 may include a pee panel used to help train boys on the proper adequate of urinating when using toilets. The pee panel may be attached to the pad body 12 so as to cover opening 22, shown in FIG. 1. The pee panel may comprise a thin paper material having a chemical agent that changes color upon exposed to urine. When a child urinates onto the pee panel, the panel will change color visually indicating to the child successful accomplishment in urinating correctly when using a toilet. The color generated both amuses the child, and provides visual training for properly aligning the discharge of urine when a child is urinating. The pee panel can be releaseably or permanently attached to inner perimeter 20 of the pad body 12. A variety of different indicia can be printed onto the visual surface of the pee panel, such as providing a target including concurrent rings and a central bullseye.

Toilets in public restroom are sometimes filthy especially in places where traffic is heavy such as in airports, truck stops, or at malls. Dirt, grime, and bacteria, often attaches to the outer surface of the toilet bowl, outer rim, and toilet stand. As a child sits on a toilet seat, the back region of the legs and feet brush against the toilet bowl exposing the clothing to possible filth. An added advantage of the potty training pad 10 is to provide a frontal flap 66 that extends downwards from the front region of the potty training pad 10 to provide a sanitary barrier between the toilet and a child's legs and feet. The frontal flap 66 may comprise a thin biodegradable sheet fabricated from any of the same materials used to fabricate the pad body 12. In one non-limiting embodiment, the frontal flap can be folded and retained in a stored position to the pad body 12 using a releasable adhesive. Users can simply pull on the frontal flap 66 to detach it from the pad body 12 allowing the frontal flap 66 to drape downwards along a vertical axis by gravity. A sticky tape or other adhesive material may be disposed on the proximate end of the frontal flap 66 allowing parents to stretch and attach the proximate end of the frontal flap 66 to the floor or lower edge of the front of the toilet to help retain the frontal flap 66 in place.

Since many modifications, variations, and changes in detail can be made to the described preferred embodiments of the invention, it is intended that all matters in the foregoing description and shown in the accompanying drawings be interpreted as illustrative and not deemed to be limiting. Furthermore, it is understood that any of the features presented in the embodiments may be integrated into any of the other embodiments unless explicitly stated otherwise. The scope of the invention should be determined by the appended claims and their legal equivalents. Modifications, additions, or omissions may be made to the systems, apparatuses, and methods described herein without departing from the scope of the disclosure. For example, the components of the system may be integrated together, or separated. Moreover, the operations of the systems and apparatuses disclosed herein may be performed by more, fewer, or other components and the methods described may include more, fewer, or other steps.

What is claimed is:

1. A biodegradable potty training pad removably attachable to a toilet seat of a toilet, said biodegradable potty training pad comprising:

a pad body including an opening formed through a central area of said pad body defining an inner perimeter, a seat area extending between said inner perimeter and an outer perimeter of said pad body, said seat area including a top surface, a bottom surface opposite said top surface, and a seat section extending from said inner perimeter towards said outer perimeter a predefined distance, said seat section covering a portion of a seat opening of said toilet seat when said pad body is releasably attached to said toilet seat;

a pair of hand flaps each having one end attached to opposite sides of said pad body, and including a first surface, a second surface opposite said first surface, and a flap attachment provided on said second surface for releasably attaching each hand flap to sides of said toilet; and a pull handle including a first end and a second end each securely attached to said pad body forming a finger aperture.

2. The biodegradable potty training pad of claim 1, further including at least one pad attachment provided on said bottom surface of said seat area, said seat section being void of said at least one pad attachment.

3. The biodegradable potty training pad of claim 2, wherein said flap attachment comprises a pressure-sensitive adhesive material covered by a releasable film.

4. The biodegradable potty training pad of claim 3, wherein said at least one pad attachment includes a plurality of pad attachments spaced apart from each other and comprising any of a pressure-sensitive adhesive material covered by a releasable film, elastomer, two-sided tape, or miniature suction cups.

5. The biodegradable potty training pad of claim 4, where said pad body comprises any of an annular, round, elliptical, or oval shape.

6. The biodegradable potty training pad of claim 5, wherein said at least one pad attachment includes a single pad attachment that comprises a pressure-sensitive adhesive material covered by a releasable film, said single pad attachment extending along the bottom surface of said seat area, said seat section being void of said single pad attachment.

7. The biodegradable potty training pad of claim 5, wherein said pull handle is foldably attachable to said pad body prior to use.

8. The biodegradable potty training pad of claim 5, wherein said first surface of each hand flap is coated, covered, or impregnated with an anti-bacterial, or anti-microbial material.

9. The biodegradable potty training pad of claim 5, wherein said first surface of each hand flap includes friction material to prevent a user's hands from slipping during use, said friction material may include any of a gritty material, raised protrusions or ridges, silicone dots, or an elastomer material.

10. The biodegradable potty training pad of claim 5, further including a front flap having one end attached to said pad body, and another end releasably detachable from said pad body for extending said front flap downwards to cover a front region of a support base of said toilet when said pad body is releasably attached to said toilet seat.

11. The biodegradable potty training pad of claim 10, wherein said pad body, said pull handle, said hand flaps, and said front flap, are each constructed from a biodegradable material comprising any of, cotton, organic cotton, sew foam, closed or open cell foam, high density polyurethane foam, natural latex foam, antimicrobial foam, fiberfill, woven or non-woven fibers, biodegradable plant based materials such as hemp, paper, bamboo, coconut fibers, feather or down, plant-based polyfoam, soybean fiber, woocoa, recycled or post-consumer fibers, biodegradable foams (Bio Foams), other natural plant derived materials, synthetic or non-synthetic fibers, renewable organic materials, wood cellulose, natural or cellulose fibers, cellulose, chitin, chitosan, gluten, gelatin, zein, soy protein, collagen, natural starches, natural rubber, or bioplastics.

12. A disposable potty aid removably attachable to an upper surface of a toilet seat including a central opening, said disposable potty aid comprising:

an annular pad body including an outer perimeter, a pad opening formed in said annular pad body defining an inner perimeter, and a seating area formed between said inner perimeter and said outer perimeter, said seating area including a top surface, and a bottom surface opposite said top surface;

at least one pad attachment provided on said bottom surface of said seating area;

a pair of hand flaps each hand flap having one end attached to opposite sides of said annular pad body, and including a hand engaging surface, and a back surface directly opposite said hand engaging surface, each back surface of each hand flap includes a flap attachment comprising a pressure-sensitive adhesive material covered by a releasable film;

a handle securely affixed to said annular pad body; and wherein said seating area includes a seat section extending from said inner perimeter to said outer perimeter a predefined distance, said seat section covering a portion of said central opening of said toilet seat when said annular pad body is releasably attached to said toilet seat, said seat section void of said at least one pad attachment.

13. The disposable potty aid of claim 12, wherein the pressure-sensitive adhesive material further comprises two-face tape, suction cups, or elastomer.

14. The disposable potty aid of claim 12, wherein said at least one pad attachment includes a plurality of pad attachments spaced apart from each other and each comprising a pressure-sensitive adhesive material covered by a releasable film, said plurality of pad attachments situated outside said seat section.

15. The disposable potty aid of claim 14, wherein said handle comprises a first end and a second end, each end attached to said pad body forming a finger aperture for receiving human fingers when grasping said handle, said handle releasably foldable to said pad body prior to use.

16. The disposable potty aid of claim 15, wherein said at least one pad attachment includes a single pad attachment extending along all or a portion of the bottom surface of said seat area, said seat section void of said single pad attachment, said single pad attachment comprising a pressure-sensitive adhesive material covered by a releasable film.

17. The disposable potty aid of claim 15, wherein each of said hand surface of each hand flap, and said top surface of said seating area, is coated, covered, or impregnated with an anti-bacterial, or anti-microbial material.

18. The disposable potty aid of claim 15, further including a front flap having one end opposite another end, said one end attached to said pad body, and said another end releasably detachable from said pad body for extending said front flap downwards to cover a front region of a support base of a toilet associated with said toilet seat when said pad body is releasably attached to said toilet seat.

19. The disposable potty aid of claim 18, where said another end of said front flap includes a pressure-sensitive adhesive material covered by a releasable film, said releasable film removed for exposing said pressure-sensitive adhesive material when attaching said another end to a surface.

20. The disposable potty aid of claim 12, wherein artistic or directive indicia is provided on any surface of the pad body, hand flaps, and handle, each of said hand flap formed in a shape, as a whole or in part, of an animal, a motif, a human body part, a fish, or an object.

* * * * *